United States Patent [19]

Miller

[11] Patent Number: 4,679,289

[45] Date of Patent: Jul. 14, 1987

[54] METHOD AND APPARATUS FOR FORMING INTRUDED BRANCH ATTACHMENT STRUCTURES IN TUBING

[75] Inventor: Donald E. Miller, Adrian, Mich.

[73] Assignee: Brazeway, Inc., Adrian, Mich.

[21] Appl. No.: 896,979

[22] Filed: Aug. 15, 1986

[51] Int. Cl.[4] ..... B21D 53/00; B23D 21/14

[52] U.S. Cl. ..... 29/157 R; 29/33 T; 83/192; 83/188

[58] Field of Search ..... 29/157 R, 157 C, 33 T, 29/33 D, 432, 282, 283.5; 72/325, 326, 327, 370; 83/178, 188, 192, 193, 194

[56] References Cited

U.S. PATENT DOCUMENTS

| | | | |
|---|---|---|---|
| 1,675,910 | 7/1928 | Riker | 72/325 |
| 2,325,437 | 7/1943 | Temple | 83/194 |
| 2,670,795 | 3/1954 | Griep | 83/178 X |
| 2,875,829 | 3/1959 | Patrick | 83/193 |
| 3,125,149 | 3/1964 | May | 29/157 R X |
| 4,162,570 | 7/1979 | Trittipoe | 29/157 R |
| 4,253,224 | 3/1981 | Hickman et al. | 29/157 T |
| 4,364,406 | 12/1982 | Bohlin | 72/325 X |

FOREIGN PATENT DOCUMENTS

| | | | |
|---|---|---|---|
| 9708 | 2/1895 | Switzerland | 83/192 |

*Primary Examiner*—Howard N. Goldberg
*Assistant Examiner*—Ronald S. Wallace
*Attorney, Agent, or Firm*—Krass & Young

[57] ABSTRACT

Method and apparatus for forming intruded sleeves in extrudable metal tubing thereby to receive branch tubes which are brazed in place. The apparatus comprises a split mandrel and a punch which drives a punch head through the tube wall section and into a pocket in the upper section of the mandrel to form the intruded sleeve structure. Removal of the mandrel is accomplished by removing a lower section, dropping the upper section off of the intruded sleeves, and thereafter removing the upper section.

2 Claims, 5 Drawing Figures

METHOD AND APPARATUS FOR FORMING INTRUDED BRANCH ATTACHMENT STRUCTURES IN TUBING

FIELD OF THE INVENTION

This invention relates to the metal working and more specifically to a method and apparatus for forming intruded branch attachment structures in extrudable metal tubing to facilitate the sucure attachment of branch tubes by brazing or the like.

BACKGROUND OF THE INVENTION

Refrigeration, dehumidification, and air conditioning systems often require the use of fluid conduit in the form of a header or main tube having a number of smaller diameter branch tubes extending therefrom and in fluid communication with the header tube. To form such products, it is typically necessary to join one or more branch tubes to the header tube such as by brazing or welding. One prior art technique for joining tubes to form branch connections is shown in U.S. Pat. No. 4,253,224 "Fixtureless Method of Making Tube Joints" granted Mar. 3, 1981 to Steven L. Hickman and Clifford E. Pifer and assigned to the assignee of the present invention.

A major problem encountered in the tube joining operation is the achievement of a substantial mechanical interrelationship between the header and branch tube to hold the parts in place prior to and during a brazing or soldering operation. In addition, the mechanical relationship between the two components must be compatible with and accepting of the brazing or soldering operation thereby to result in a strong and fluid-tight joint.

SUMMARY OF THE INVENTION

According to the apparatus aspect of the invention, means including a mandrel which can be located internally of the header tube and a punch which operates in combination with the mandrel are provided to form intruded branch attachment holes or apertures which are capable of receiving and securing one or more branch tubes in firm mechanical association prior to and during the brazing operation.

Specifically, the apparatus comprises, in addition to a length of extrudable metal tubing as a workpiece, a mandrel which is locatable within the length of tubing and which exhibits upper and lower sections. The two sections are essentially stacked on top of one another in axially sliding relationship while disposed within the tubing. The upper section has one or more pockets formed therein which open to the interior surface of the tube wall. The punch comprises one or more punch heads arranged to correspond and be aligned with the pockets in the upper section of the mandrel. The punch head is driven through the tube wall and into the pocket such that material is displaced from the tube wall fills a gap between the exterior surface of the punch head and the interior surface of the pocket in the upper section of the mandrel thereby to form an intruded branch attachment sleeve which extends radially into the header tube. Removal of the mandrel is facilitated by means of the two part nature thereof; the lower section can be removed from the tubing thereby allowing the upper section to drop downwardly off of the intruded sleeves such that it too can be removed.

According to the process aspect of the invention, a method or process is provided for forming intruded branch attachment apertures and internally extending sleeves in tubing. In general, the method comprises the steps of placing a split mandrel into the tubing, the upper section of the mandrel having formed therein one or more pockets which open to the interior tube wall. The method comprises the further step of driving a punch head through the tube wall and into the pocket thereby displacing tube wall material into a gap between the punch head and the mandrel pocket to form an internally projecting sleeve which is capable of receiving and supporting in mechanical relationship a branch tube. The method further comprises steps necessary for the removal of the mandrel; i.e., first the removal of the lower portion of the split mandrel, second the displacement of the upper portion of the mandrel off of the internally projecting sleeves, and the subsequent removal of the upper portion of the mandrel.

DETAILED DESCRIPTION OF THE SPECIFIC EMBODIMENT

Figure 1:
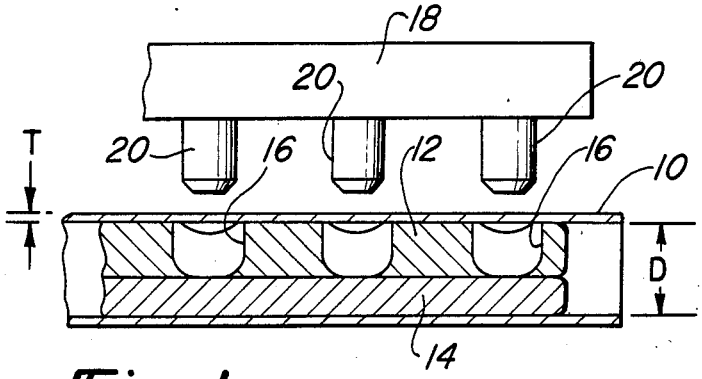
FIG. 1 is a side view in section of a length of header tube with an apparatus associated therewith for forming intruded branch attachment holes according to the invention.

Referring to the drawing, a length of header tube 10 made of an extrudable material such as aluminum is shown to have an interior diameter D and a relatively uniform wall thickness T. The reference to an "extrudable" material does not necessarily require that the tube 10 actually be extruded; rather, it is intended to convey the fact that the material of the tube 10 can be caused to flow inelastically under pressure to a new and permanent configuration. Tube 10 constitutes the workpiece upon which the method of the present invention is performed as hereinafter described.

In association with tube 10 is a split mandrel comprising an upper section 12 and a lower section 14. The two sections 12 and 14 of the mandrel are susceptible of being placed in stacked relationship within the tube 10, the sections 12 and 14 in the stacking direction being such as to substantially occupy the entire interior diameter D of the tube 10.

The upper section 12 has formed therein a series of spaced pockets 16, the diameter of which is less than the diameter D of the tubing 10 and which open to the interior tube wall surface as shown. In the stacked relationship, the mandrel sections 12 and 14 are axially slideable relative to one another. Section 14 is preferably solid and both sections 12 and 14 are made of a rigid and durable material such as steel.

Figure 2:
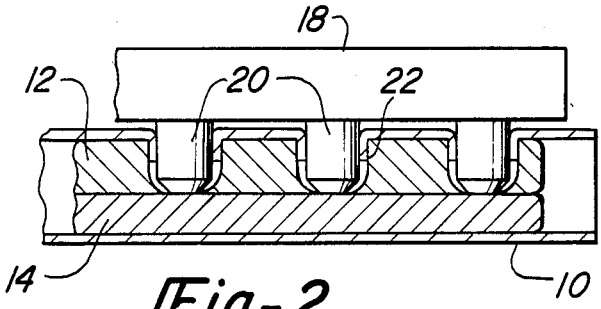
FIG. 2 is similar to FIG. 1 but with the punch head driven into the tube wall to form the intruded branch attachment sleeves.
Figure 3:
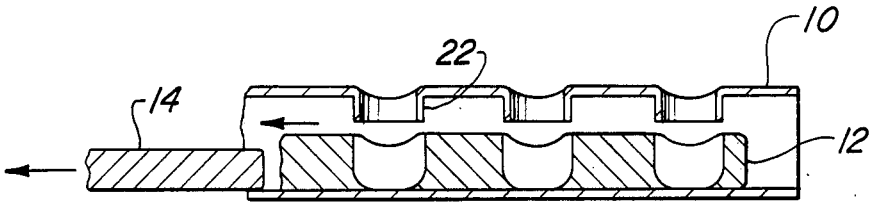
FIG. 3 is a view of the apparatus of FIGS. 1 and 2 in a subsequent stage of utilization involving the withdrawl of the mandrel.

The apparatus of the invention further comprises a punch 18 having a plurality of cylindrical punch heads 20 which are aligned with the center lines of the pockets 16 in the upper section 12 of the mandrel. The diameters of the punch heads 20 are less than the interior diameters of the pockets 16 thereby to leave a gap or radial spacing between the punch heads 20 and the pockets 16 when the punch heads 20, as shown in FIG. 2, are driven through the tube wall and into the pockets as hereinafter described.

FIG. 1, as will be apparent to those skilled in the art, represents the set-up of the apparatus just prior to the formation of intruded sleeves 22 defined by holes in the tube wall and formed by displacing material from the tube wall toward the interior center line of the tube 10 and into the gap between punch heads 20 and the interior surfaces of the pockets 16 in the upper mandrel section 12. FIG. 2, on the other hand, represents the disposition of the punch 18 and the punch heads 20 after the punching operation and clearly shows the formation of the sleeves 22 in the gaps between the punch heads 20 of the pockets 16 of the mandrel section 12. The lower section 14 of the mandrel provides support for the upper section 12 during the punching operation. Suitable stops and fixtures to maintain the required alignment will be apparent to those skilled in the art and need not be described in detail.

Once the intruded sleeves 22 and the holes defined thereby are formed, it becomes necessary to remove the sections 12 and 14 of the mandrel from the tube 10. This is accomplished by first sliding the lower section 14 of the mandrel out of the tube in the axial direction and subsequently dropping the upper section 12 of the mandrel down into the volume previously occupied by the lower section 14 and thereafter sliding the upper section 12 of the mandrel axially out of the tube 10.

Figure 4:
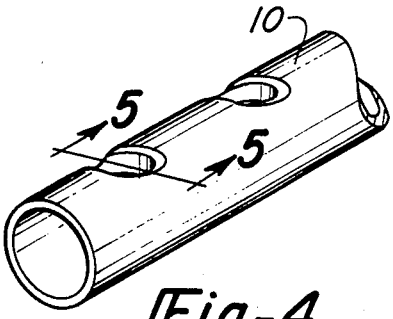
FIG. 4 is a perspective view of a short length of header tube showing intruded branch attachment holes formed in accordance with the invention.
Figure 5:
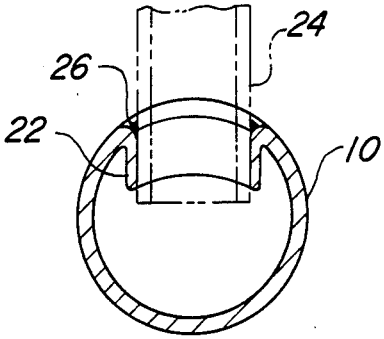
FIG. 5 is a cross-sectional view of the header tube of FIG. 4 with a branch attachment tube indicated in phantom lines.

FIGS. 4 and 5 indicate the nature of the finished product. In FIG. 5, a branch tube 24 is shown in phantom lines inserted into the sleeve 22 and brazed in place by means of brazing material 26 which fills the very small interstice between the branch tube 24 and the sleeve 22 to form a fluid-tight joint caplable of withstanding substantial pressure.

Although it is believed to be readily apparent from the foregoing description, the steps of the steps of the process which forms part of the present invention will be described. First, the mandrel consisting of stacked upper and lower sections 12 and 14 is placed within the tube 10 and in proper alignment with the heads 20 of the punch 18. Thereafter an hydraulic or mechanical press or the like is operated to drive the punch 18 radially into the tube 10, piercing the tube wall and causing the material from the tube wall to be displaced to form the sleeves 22 in the gaps between the punch heads 20 and the interior surfaces of the pockets 16. Thereafter the punch 18 is withdrawn and the lower section 14 of the mandrel is pulled axially out of the tubing 10. This allows the upper section 12 of the mandrel to drop down off of the sleeves 22 and to be similarly withdrawn from the tube 10 by axial displacement. The now-finished tube 10 is ready to accept one or more branch tubes 24 which, by reason of the intruded sleeves 22, are firmly held in place before and during a brazing operation.

I claim:

1. Apparatus for forming intruding branch attachment structure in tubing comprising:

a mandrel locatable within a length of extrudable metal tubing, said tubing having an inner diameter D and a wall thickness T, said mandrel having an upper section and a lower section, the upper and lower sections being disposed in mutually slideable, stacked relationship to occupy essentially the entire interior diameter D of the tubing, the upper section having formed therein one or more pockets of interior dimension less than D and opening to the interior wall surface of the tubing; and a punch having at least one punch head portion aligned with a pocket in the upper section of said mandrel, the punch head portion being of a lateral dimension which is less than the interior dimension of the pocket with which it is aligned, said punch being driveable through the wall of said tubing and into said pocket thereby to displace the wall material of said tubing into the gap between the punch head portion and the pocket to form an intruded sleeve in said tubing.

2. A method for forming branch tube attachment structures in extrudable metal tubing comprising the steps of:

placing a split mandrel within the tube in stacked relationship so as to substantially occupy the interior diameter of said tube, the upper section of the split mandrel having at least one pocket of diameter less than the interior diameter of the tube formed therein and opening to the interior surface of the tube wall;

driving a punch head through the tube wall and into the pocket to displace tube wall material inwardly and into a radial gap between the punch head and the interior surface of the pocket;

withdrawing the punch;

removing the lower section of the split mandrel from the tube; and, thereafter releasing the upper section of the split mandrel from the intruded structure of the tube formed by the punching operation and removing the upper section of the mandrel from the tube.

* * * * *